US011510535B2

(12) United States Patent
Lee et al.

(10) Patent No.: US 11,510,535 B2
(45) **Date of Patent: *Nov. 29, 2022**

(54) ROBOT CLEANER

(71) Applicant: LG Electronics Inc., Seoul (KR)

(72) Inventors: Seungjin Lee, Seoul (KR); Hwang Kim, Seoul (KR); Sangik Lee, Seoul (KR); Seaunglok Ham, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 463 days.

This patent is subject to a terminal disclaimer.

(21) Appl. No.: 16/659,816

(22) Filed: Oct. 22, 2019

(65) Prior Publication Data

US 2021/0113038 A1 Apr. 22, 2021

(51) Int. Cl.

| | |
|---|---|
| ***A47L 9/00*** | (2006.01) |
| ***A47L 11/40*** | (2006.01) |
| ***A47L 9/28*** | (2006.01) |

(52) U.S. Cl.

CPC ..... *A47L 9/009* (2013.01); *A47L 9/2826* (2013.01); *A47L 9/2852* (2013.01); *A47L 11/4011* (2013.01); *A47L 11/4052* (2013.01); *A47L 11/4061* (2013.01); *A47L 11/4066* (2013.01); *A47L 11/4072* (2013.01); *A47L 2201/04* (2013.01)

(58) Field of Classification Search

CPC ..... A47L 9/009; A47L 9/2826; A47L 9/2852; A47L 11/4011; A47L 11/4052; A47L 11/4061; A47L 11/4066; A47L 11/4072; A47L 2201/04; A47L 9/0494; A47L 9/1683; A47L 9/1691

See application file for complete search history.

(56) References Cited

U.S. PATENT DOCUMENTS

| | | | | |
|---|---|---|---|---|
| 2018/0184875 | A1* | 7/2018 | Youk | A47L 9/1427 |
| 2019/0239710 | A1* | 8/2019 | Lee | A47L 9/2826 |
| 2019/0282055 | A1* | 9/2019 | Lee | A47L 9/2873 |

FOREIGN PATENT DOCUMENTS

| | | |
|---|---|---|
| KR | 10-2009-0129029 | 12/2009 |
| KR | 10-2016-0107663 | 9/2016 |

(Continued)

OTHER PUBLICATIONS

PCT Search Report dated Apr. 10, 2020.

Taiwan Office Action of Application No. 108140314 dated Apr. 15, 2020.

*Primary Examiner* — David Redding

(74) *Attorney, Agent, or Firm* — Birch, Stewart, Kolasch & Birch, LLP

(57) ABSTRACT

A robot cleaner includes a main body, and a wheel unit including a wheel configured to movably support the main body. The wheel unit is installed in a suspension unit and configured to be movable upward or downward. The suspension unit is configured to absorb impact when the wheel unit moves upward or downward, and is installed in a lifting unit coupled to the main body. The suspension unit is configured to be raised or lowered relative to the lifting unit. The lifting unit includes a lifting drive motor including a rotatable shaft disposed in parallel with a direction in which the suspension unit is configured to be raised or lowered, and a transmission unit configured to transmit a rotation force of the lifting drive motor to the suspension unit.

13 Claims, 11 Drawing Sheets

(56) References Cited

FOREIGN PATENT DOCUMENTS

| | | |
|---|---|---|
| KR | 10-2019-0021294 | 3/2019 |
| KR | 10-1984012 | 5/2019 |
| KR | 10-2019-0094697 | 8/2019 |
| TW | 201936108 | 9/2019 |
| WO | WO 2019/041754 | 3/2019 |

* cited by examiner

ROBOT CLEANER

TECHNICAL FIELD

The present disclosure relates to a robot cleaner and, more particularly, to a robot cleaner capable of traveling on floors of various materials.

BACKGROUND

Generally, a cleaner includes a main body having a suction device and a dust container, and a cleaning nozzle connected to the main body to perform cleaning in a state close to a surface to be cleaned. The cleaner is divided into a manual cleaner which is directly manipulated by a user to clean the surface to be cleaned, and a robot cleaner which autonomously cleans the surface to be cleaned while the main body travels.

In the manual cleaner, if a user places the cleaning nozzle on the surface to be cleaned while holding the main body in a state in which the suction device generates suction force by the driving force of an electric motor, the cleaning nozzle sucks foreign substances containing dust on the surface to be cleaned and the sucked foreign substances are collected in the dust container, thereby cleaning the surface to be cleaned.

The robot cleaner further includes an ultrasonic sensor and/or a camera sensor on the main body provided with the suction device and the dust container. While the main body autonomously travels around the surface to be cleaned, the cleaning nozzle sucks foreign substances on the surface to be cleaned by the suction force generated by the suction device and the sucked foreign substances are collected in the dust container, thereby cleaning the surface to be cleaned.

When a carpet is laid on the floor of a room to be cleaned, strands of the carpet are sucked into a suction port by the suction force of the cleaning nozzle, thereby causing load while the cleaner travels. In addition, since the carpet has a height difference with the floor on which the carpet is placed, there are various traveling environments in which the cleaner is ascending the carpet, the cleaner is travelling on the carpet, and the cleaner is descending the carpet. Therefore, it may be necessary for the robot cleaner to stably travel under a traveling condition on various floors.

SUMMARY

The present disclosure aims to provide a robot cleaner capable of moving to a position desired thereby even when a traveling environment of a floor is changed. The present disclosure also provides a robot cleaner capable of ascending a region having a height difference with a floor.

The present disclosure aims to provide a robot cleaner having a configuration in which a main body is lifted with respect to a suspension unit that absorbs impact of a wheel unit so that the suspension unit maintains a function of absorbing impact even when the height of the main body is adjusted.

The present disclosure aims to provide a robot cleaner for raising a main body when the main body formed with a charging port on the lower surface of the main body attempts to dock with an external docking device to charge a battery inside the main body so that the charging port is connected to the docking device.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

The present disclosure provides a robot cleaner capable of reducing slip by raising a main body using slip information obtained by sensing sensor or brush motor load when slip occurs while the robot cleaner travels on a carpet.

The present disclosure provides a robot cleaner in which a main body moves to a docking device in a lifted state in the vicinity of the docking unit, for automatic charging, and then is lowered after docking with the docking device so as to open a charging port to perform automatic charging.

The present disclosure provides a cleaner for automatically adjusting a setting height according to a floor environment. The present disclosure provides an operation structure capable of driving a motor according to a signal of a controller using a motor and a gear and raising or lowering a suspension according to driving of the motor.

The present disclosure provides a robot cleaner capable of simplifying an inner structure of the cleaner commonly using a part of a structure in which a suspension unit guides a wheel unit to be raised or lowered and a structure in which the suspension unit guides a raising or lowering trajectory with respect to a lifting unit.

Specifically, the trajectory of the suspension unit moving with respect to the lifting unit may be guided by a guide bar. In addition, the trajectory of the wheel unit moving with respect to the suspension unit may be guided by the guide bar. That is, since the movement trajectories of the suspension unit, the lifting unit, and the wheel unit may be limited altogether by the same guide bar, a configuration is simply implemented.

The present disclosure provides a robot cleaner including a main body; a wheel unit including a wheel movably supporting the main body; a suspension unit in which the wheel unit is installed to be movable upward or downward, the suspension unit being configured to absorb impact when the wheel unit moves upward or downward; and a lifting unit in which the suspension unit is installed to be raised or lowered, the lifting unit being coupled to the main body.

In this case, the lifting unit includes a housing, a lifting drive motor which is fixed to the housing and includes a rotating shaft disposed in parallel with a direction in which the suspension unit is raised with respect to the lifting unit, and a transmission unit configured to transmit a rotation force of the lifting drive motor to the suspension unit.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
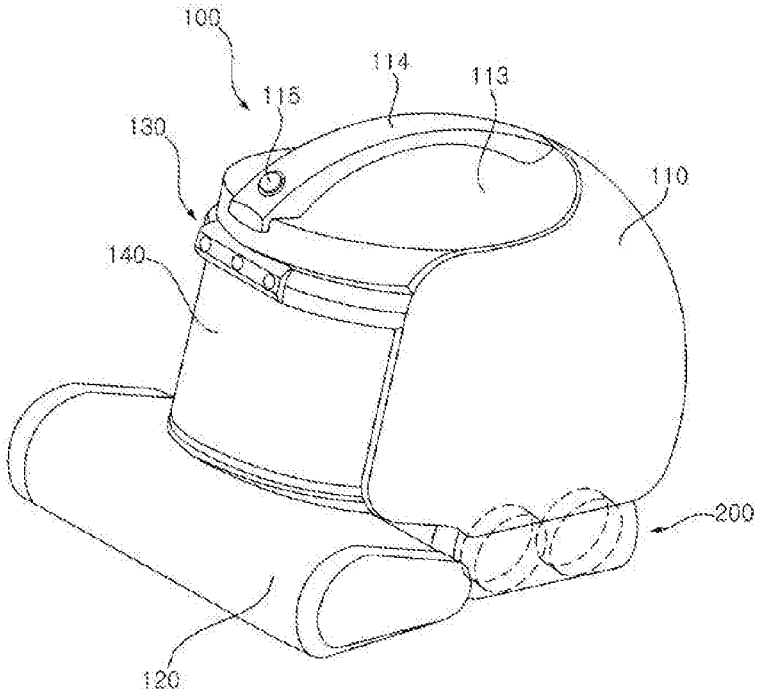
FIG. 1 is a perspective view illustrating a cleaner according to an embodiment of the present disclosure.

Reference will now be made in detail to exemplary embodiments of the present disclosure, examples of which are illustrated in the accompanying drawings.

The size or shapes of elements illustrated in the drawings may be exaggerated for simplicity and convenience of description. Further, terms specially defined in consideration of configuration and operation of the present disclosure may vary according to intention or customs of a user or an operator. Thus, the definition of these terms should be made based on the whole contents disclosed in the present specification.

Figure 2:
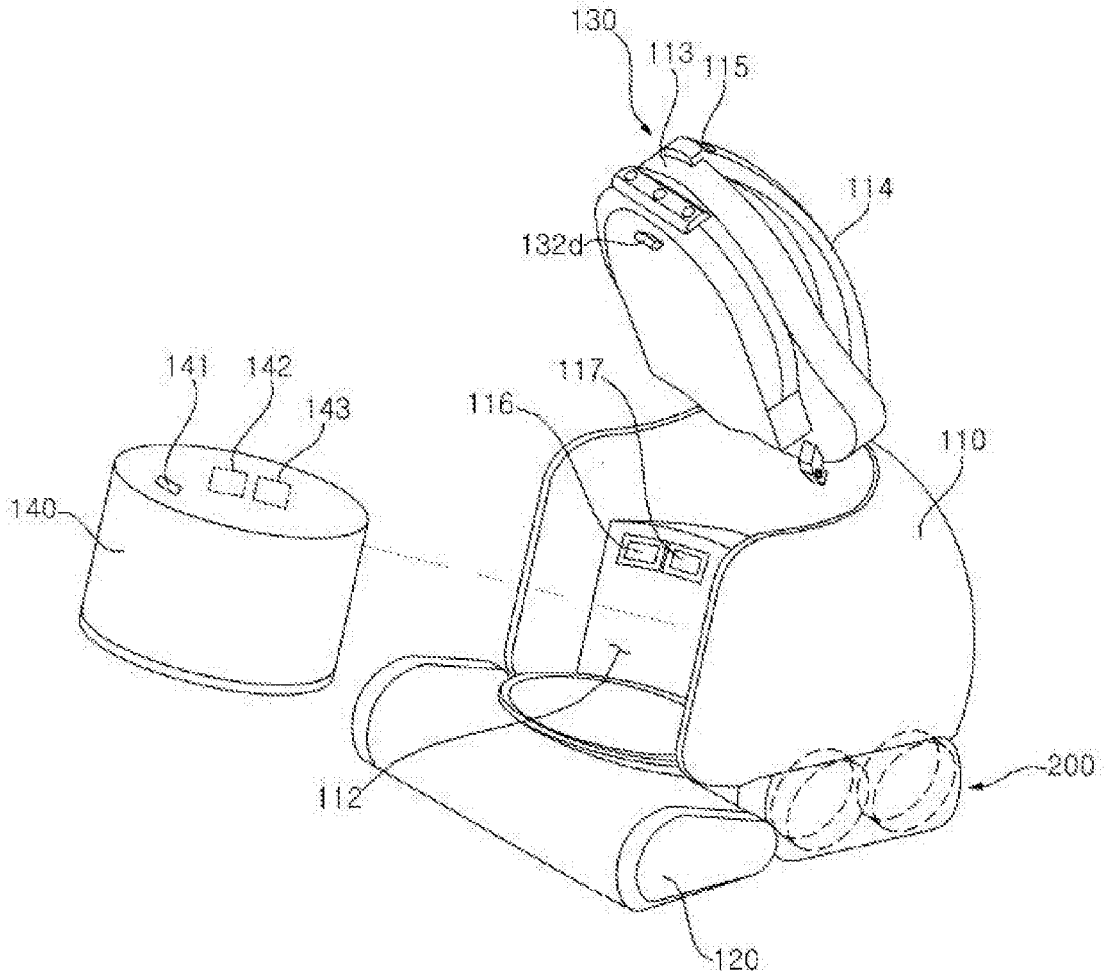
FIG. 2 is a view illustrating a cleaner in a state in which a dust container is separated from the cleaner of FIG. 1.

FIG. 1 is a perspective view illustrating a cleaner according to an embodiment of the present disclosure, and FIG. 2 is a view illustrating a cleaner in a state in which a dust container is separated from the cleaner of FIG. 1.

Referring to FIGS. 1 and 2, a cleaner 100 includes a main body 110, a cleaning nozzle 120, a sensing unit 130, and a dust container 140.

Various components including a controller (not shown) for controlling the cleaner 100 are installed or mounted in the main body 110. The main body 110 may form a space in which various the components constituting the cleaner 100 are accommodated.

The main body 110 is provided with a wheel unit 200 for causing the main body 110 to travel. The wheel unit 200 may include a motor (not shown) and at least one wheel rotated by the driving force of the motor. The rotation direction of the motor may be controlled by the controller (not shown). Then, the wheels of the wheel unit 200 may be configured to be rotatable clockwise or counterclockwise.

The wheel unit 200 may be disposed at each of both left and right sides of the main body 110. The main body 110 may be moved or rotated by the wheel unit 200 backward, forward, left, or right.

Each wheel unit 200 may be configured to be driven independently. To this end, each wheel unit 200 may be driven by a different motor.

The controller controls the driving of the wheel unit 200, so that the cleaner 100 autonomously travels on the floor.

The wheel unit 200 is disposed at the lower portion of the main body 110 to cause the main body 110 to travel. The wheel unit 200 may be configured only by circular wheels, may be configured by connecting circular rollers by a belt chain, or may be configured by combining the circular wheels and the circular rollers connected by the belt chain. The upper portion of the wheels of the wheel unit 200 may be disposed within the main body 110 and the lower portion of the wheel unit 200 may protrude downward from the main body 110.

The wheel unit 200 may be installed on each of the left side and the right side of the main body 110. The wheel unit 200 disposed on the left side of the main body 110 and the wheel unit 200 disposed on the right side of the main body 110 may be driven independently of each other. That is, the wheel unit 200 disposed on the left side of the main body 110 may be connected to each other through at least one gear and may be rotated by the driving force of a first travel motor for rotating the gear. In addition, the wheel unit 200 disposed on the right side of the main body 110 may be connected to each other through at least one gear and may be rotated by the driving force of a second travel motor for rotating the gear.

The controller may determine a travel direction of the main body 110 by controlling the rotation speeds of respective rotating shafts of the first travel motor and the second travel motor. For example, when the rotating shafts of the first travel motor and the second travel motor are simultaneously rotated at the same speed, the main body 110 may travel straight. When the rotating shafts of the first travel motor and the second travel motor are simultaneously rotated at different speeds, the main body 110 may steer to the left or the right. To cause the main body 110 to steer to the left or the right, the controller may drive one of the first travel motor and the second travel motor and stop the other one of the first travel motor and the second travel motor.

A suspension unit may be installed inside the main body 110. The suspension unit may include a coil spring. The suspension unit may absorb impact and vibration transmitted from the wheel unit 200 using the elastic force of the coil spring when the main body 110 travels.

In addition, the suspension unit may be provided with a lifting unit for adjusting the height of the main body 110. The lifting unit may be installed in the suspension unit to be movable upward and downward and may be coupled to the main body 110. Therefore, when the lifting unit moves upward from the suspension unit, the main body 110 may also move upward together with the lifting unit and, when the lifting unit moves downward from the suspension unit, the main body 110 may also move downward together with the lifting unit. Since the main body 110 may move upward or downward by the lifting unit, the height thereof is adjusted.

When the main body 110 travels on a hard floor surface, the wheels of the wheel unit 200 may move in a state in which the bottom surface of the cleaning nozzle 120 is in close contact with the floor surface to clean the floor surface. However, when a carpet is laid on the floor surface to be cleaned, slip may occur on the wheels of the wheel unit 200 so that the travel performance of the main body 110 may be deteriorated. Furthermore, the travel performance of the main body 110 may also be deteriorated by the suction force of the cleaning nozzle 120 that sucks the carpet.

However, since the lifting unit adjusts the height of the main body 110 according to a slip ratio of the wheels of the wheel unit 200, the degree of contact between the bottom surface of the cleaning nozzle 120 and the floor surface to be cleaned may be adjusted so that the travel performance of the main body 110 of the cleaner may be maintained regardless of the material of the floor surface to be cleaned.

The main body 110 is equipped with a battery (not shown) for supplying power to electrical components of the cleaner 100. The battery is configured to be chargeable and may be configured to be detachable from the main body 110.

The main body 110 is provided with a dust container accommodating portion 112. A dust container 140 for separating dust and air to collect dust in sucked air is detachably coupled to the dust container accommodating portion 112. The dust container accommodating portion 112 may have a shape which is opened in forward and upward directions of the main body 110 and may be formed to be concave toward the rear side from the front side of the main body 110. The front part of the main body 110 may have an open front, an open top, and an open bottom. The dust container accommodating portion 112 may be formed at another position (for example, the back side of the main body 110) according to the type of the cleaner.

The dust container 140 is detachably coupled to the dust container accommodating portion 112. Part of the dust container 140 is accommodated in the dust container accommodating portion 112 and the other part of the dust container 140 may be formed to protrude toward the front of the main body 110.

The dust container 140 has an inlet 142 through which dust-included air is introduced and an outlet 143 through which dust-separated air is discharged. When the dust container 140 is mounted in the dust container accommodating portion 112, the inlet 142 and the exit 143 are configured to communicate with a first opening 116 and a second opening 117, respectively, formed on the inner wall of the dust container accommodating portion 112.

An air suction passage formed inside the main body 110 corresponds to a passage from the cleaning nozzle 120 to the first opening 116, and an air exhaust passage corresponds to a passage from the second opening 117 to an exhaust port.

Dust-included air introduced through the cleaning nozzle 120 is introduced into the dust container 140 via the air suction passage inside the main body 110 and is separated from the dust while passing through at least one filter portion (e.g., a cyclone or filter) in the dust container 140. The dust is collected in the dust container 140, and the air is discharged from the dust container 140. Then, the air passes through the air exhaust passage inside the main body 110 and is finally discharged to the outside through the exhaust port.

An upper cover 113 covering the dust container 140 accommodated in the dust container accommodating portion 112 is disposed in the main body 110. The upper cover 113 may be hinged to one side of the main body 110 to be rotatable. The upper cover 113 covers the opened upper side of the dust container accommodating portion 112 to cover the upper side of the dust container 140. The upper cover 113 may be detachably separated from the main body 110.

In a state in which the upper cover is disposed to cover the dust container 140, separation of the dust container 140 from the dust container accommodating portion 112 may be limited.

A handle 114 is provided on the upper side of the upper cover 113. A capture unit 115 may be disposed on the handle 114. The capture unit 115 may be disposed to be inclined with respect to the bottom surface of the main body 110 so as to capture a front direction and an upper direction together.

The capture unit 115 may be provided in the main body 110 to capture images for simultaneous localization and mapping (SLAM) of the cleaner. The images captured by the capture unit 115 are used to generate a map of a travel area or sense a current position in the travel area.

The capture unit 115 may generate 3-dimensional (3D) coordinate information related to the periphery of the main body 110. That is, the capture unit 115 may be a 3D depth camera that calculates the distance between the cleaner 100 and an object to be captured. Accordingly, field data on the 3D coordinate information may be generated.

Specifically, the capture unit 115 may capture a 2-dimensional (2D) image related to the periphery of the main body 110 and generate a plurality of 3D coordinate information corresponding to the captured 2D image.

In an embodiment, the capture unit 115 includes two or more cameras for acquiring a conventional 2D image and combines two or more images acquired by the two or more cameras to generate 3D coordinate information in a stereo-vision type.

The capture unit 115 includes a first pattern irradiator for irradiating light of a first pattern downward toward the front of the main body, a second pattern irradiator for irradiating light of a second pattern upward toward the front of the main body, and an image acquirer for acquiring an image of the front of the main body. Then, the image acquirer may acquire an image of a region upon which light of the first pattern and light of the second pattern are incident.

In addition, the capture unit 115 may include an infrared pattern irradiator for irradiating an infrared pattern together with a single camera and capture a shape formed by projecting the infrared pattern irradiated by the infrared pattern irradiator onto a captured object, thereby measuring the distance between the capture unit 115 and the captured object. The capture unit 115 may be an infrared (IR) capture unit 115.

The capture unit 115 may include a light emitter for emitting light together with a single camera. The capture unit 115 may receive a part of laser rays reflected from the captured object among laser rays emitted by the light emitter and analyze the received laser rays, thereby measuring the distance between the capture unit 115 and the captured object. The capture unit 115 may be a time-of-flight (TOF) capture unit 115.

The capture unit 115 is configured to irradiate laser rays of a type extended in at least one direction. In an example, the capture unit 115 may include first laser rays and second laser rays. The first lasers may irradiate straight laser rays that cross each other and the second lasers may irradiate laser rays of a single straight type. Then, bottom laser rays are used to sense obstacles at a bottom part of the main body and top laser rays are used to sense obstacles at a top part of the main body. Middle laser rays between the bottom laser rays and the top laser rays are used to sense obstacles in a middle part of the main body.

The sensing unit 130 may be disposed at the lower part of the upper cover 113 and may be detachably coupled to the dust container 140.

The sensing unit 130 is disposed in the main body 110 and senses information related to an environment in which the main body 110 is located. The sensing unit 130 senses the information related to the environment to generate field data.

The sensing unit 130 senses surrounding features (including obstacles) so that the cleaner 100 does not collide with the obstacles. The sensing unit 130 may sense information about the outside of the cleaner 100. The sensing unit 130 may sense a user around the cleaner 100. The sensing unit 130 may sense an object around the cleaner 100.

In addition, the sensing unit 130 may be configured to be panned (movement to the left and right) and tilted (arrangement to be inclined upward and downward) in order to improve sensing and travel functions of the robot cleaner.

The sensing unit 130 is disposed at the front side of the main body 110 and is disposed between the dust container 140 and the upper cover 113. An engaging protrusion **132*d*** is formed to protrude from the lower side of the sensing unit 130. An engaging groove 141 into which the engaging protrusion 132*d* is inserted so that the engaging protrusion 132*d* is engaged with the engaging groove 141 is formed on the upper side of the dust container 140. When the upper side of the dust container accommodating portion 112 is opened by uncovering the upper cover 113, the engaging protrusion 132*d* is inserted into the engaging groove 141 so that the dust container 140 is coupled to the sensing unit 130 and becomes inseparable from the main body 110. In contrast, when the upper cover 113 uncovers the upper side of the dust container accommodating portion 112, the engaging projection 132*d* exists from the engaging groove 141 so that the dust container 140 is decoupled from the sensing unit 130 and becomes separable from the main body 110.

The sensing unit 130 may include at least one of an external signal sensor, an obstacle sensor, a cliff sensor, a lower camera sensor, an upper camera sensor, a current sensor, an encoder, an impact sensor, or a microphone.

The external signal sensor may sense an external signal of the cleaner 100. The external signal sensor may be, for example, an IR sensor, an ultrasonic sensor, a radio frequency (RF) sensor, etc. Accordingly, field data on the external signal may be generated.

The cleaner 100 may sense information about the position and direction of a charging station by receiving a guide signal generated from the charging station using the external signal sensor. Herein, the charging station may generate a guide signal indicating a direction and a distance such that the cleaner 100 may return thereto. That is, the cleaner 100 may determine a current position by receiving the signal generated from the charging station and may return to the charging station by setting a moving direction.

The obstacle sensor may sense an obstacle located in front of the cleaner. Accordingly, field data on the obstacle is generated. The obstacle sensor may sense an object present in a moving direction of the cleaner 100 and transmit the generated field data to the controller. That is, the obstacle sensor may sense protrusions, furnishings, furniture, wall surfaces, wall corners, etc. which are present in a movement path of the cleaner 100 and transmit the field data to the controller. The obstacle detecting sensor may be, for example, an IR sensor, an ultrasonic sensor, an RF sensor, a geomagnetic sensor, etc. The cleaner 100 may use one type of sensor as the obstacle sensor or use two or more types of sensors together if necessary.

The cliff sensor may mainly use various shapes of optical sensors to sense an obstacle on a floor that supports the main body 110. Accordingly, field data on the obstacle on the floor is generated. The cliff detection sensor may be an IR sensor, an RF sensor, a position sensitive detector (PSD) sensor, etc., each of which includes a light emitter and a light receiver as in the obstacle sensor.

For example, the cliff sensor may be a PSD sensor or a plurality of different types of sensors. The PSD sensor may include a light emitter for emitting IR rays to an obstacle and a light receiver for receiving IR rays which return after being reflected from the obstacle. Generally, the PSD sensor may be formed as a module. If an obstacle is sensed using the PSD sensor, a stable measurement value may be obtained regardless of difference in reflectivity or color of the obstacle.

The controller may sense a cliff by measuring an IR angle between a light emitting signal of IR rays radiated by the cliff sensor towards the ground and a reflection signal received after being reflected from an obstacle and acquire field data on the depth of the cliff.

The cliff sensor may sense the material of a floor. The cliff sensor may sense the reflectivity of light reflected from the floor and determine the material of the floor according to the reflectivity. For example, if the material of the floor is marble with a good reflectivity, the reflectivity of light sensed by the cliff sensor will appear to be high. If the material of the floor is wood, a papered floor, or a carpet having a worse reflectivity relative to marble, the reflectivity of light sensed by the cliff sensor will appear to be relatively low. Accordingly, the controller may determine the material of the floor using the reflectivity of the floor sensed by the cliff sensor and determine that the floor is a carpet when the reflectivity of the floor is a preset reflectivity.

In addition, the cliff sensor senses the distance to the floor and the controller may determine the material of the floor according to the distance to the floor. For example, if the cleaner is located on a carpet laid on the floor, the cliff sensor may sense the distance to the floor to be closer than the distance to the floor on which the carpet is not laid. Accordingly, the controller may determine the material of the floor using the distance to the floor sensed by the cliff sensor and determine that the material of the floor is the carpet when the distance to the floor is equal to or longer than a preset distance.

The lower camera sensor acquires image information (field data) on a surface to be cleaned during movement. The lower camera sensor is also referred to as an optical flow sensor. The lower camera sensor may convert an image of a lower side, input from an image sensor provided in the lower camera sensor, to generate image data (field data) of a predetermined format. Field data on an image recognized using the lower camera sensor may be generated. The controller may detect the position of the robot cleaner using the lower camera sensor regardless of the sliding of the robot cleaner. The controller may compare and analyze data on images captured by the lower camera sensor over time to calculate a travel distance and a travel direction. The controller calculates the location of the robot cleaner based on the calculated distance and direction.

The lower camera sensor may capture the floor and the controller may determine the material of the floor by analyzing an image captured by the lower camera sensor. The control unit may configure images corresponding to materials of the floor. If an image captured by the lower camera sensor includes the configured image, the controller may determine that the material of the floor is a material corresponding to the configured image. The controller may determine that the material of the floor is a carpet when the captured image includes the configured image corresponding to an image of the carpet.

The upper camera sensor may be installed to face towards the upper side or front side of the cleaner 100 to capture images around the cleaner 100. If the cleaner 100 is provided with a plurality of upper camera sensors, the upper camera sensors may be provided on the upper part or a side surface of the robot cleaner with a predetermined distance or a predetermined angle therebetween. Field data on an image recognized by the upper camera sensor may be generated.

The current sensor senses a current resistance value of the wheel drive motor, and the controller may determine the material of the floor according to the current resistance value sensed by the current sensor. For example, when the cleaning nozzle 120 is positioned on the carpet on the floor, strands of the carpet are sucked through a suction port of the cleaning nozzle 120, thereby hindering traveling of the cleaner. In this case, current resistance will occur due to load between a rotor and a stator of the wheel drive motor. The current sensor may sense the current resistance value generated by the wheel drive motor, and the controller may determine the material of the floor according to the current resistance value. If the current resistance value is equal to or greater than a preset value, the controller may determine that the material of the floor is the carpet.

The encoder may sense information related to operation of a motor that drives the wheels of the wheel unit 200. Accordingly, field data on the operation of the motor is generated.

The impact sensor may sense impact during collision of the cleaner 100 with an external obstacle. Accordingly, field data on the external impact is generated.

The microphone may sense external sound. Accordingly, field data on the external sound is generated.

The cleaning nozzle 120 is configured to suck dust-included air or wipe the floor. Herein, the cleaning nozzle 120 configured to suck dust-included air may be referred to as a suction module and the cleaning nozzle 120 configured to wipe the floor may be referred to as a mop module.

The cleaning nozzle 120 may be detachably coupled to the main body 110. When the suction module is separated from the main body 110, the mop module may be detachably coupled to the main body 110 by replacing the separated suction module. Therefore, the user who desires to remove dust from the floor may mount the suction module on the main body 110 and the user who desires to wipe the floor may mount the mop module on the main body 110.

The cleaning nozzle 120 may be configured to have a function of wiping the floor after sucking dust-included air.

The cleaning nozzle 120 may be disposed at the lower part of the main body 110 or may be disposed to protrude from one side of the main body 110 as shown. The one side may be a side at which the main body 110 travels in a forward direction, i.e., the front side of the cleaner main body 110. The cleaning nozzle 120 may be disposed in front of the wheel unit 200 so that a part of the cleaning nozzle 120 may protrude forward from dust container 140.

FIGS. 1 and 2 show that the cleaning nozzle 120 has a shape protruding from one side of the main body 110 to a forward side and both left and right sides. Specifically, the front end of the cleaning nozzle 120 is disposed at a position spaced forward from one side of the main body 110 and both the left and right ends of the cleaning nozzle 120 are disposed at positions spaced from the one side of the main body 110 to the left and right sides, respectively.

A suction motor may be installed inside the main body 110. An impeller (not shown) may be coupled to a rotating shaft of the suction motor. When the suction motor is driven to rotate the impeller along the rotating shaft, the impeller may generate suction force.

The air suction passage may be formed inside the main body 110. Foreign substances, including dust, may be introduced into the cleaning nozzle 120 from a surface to be cleaned by the suction force generated by the driving force of the suction motor and the foreign substances introduced into the cleaning nozzle 120 may be introduced into the air suction passage.

The cleaning nozzle 120 may be disposed adjacent to the bottom surface of the main body 110 among all surfaces of the main body 110. A suction port through which air is sucked may be formed on the bottom portion of the cleaning nozzle 120. The suction port may be disposed toward the bottom surface when the cleaning nozzle 120 is coupled to the main body 110.

The cleaning nozzle 120 may include a case in which the suction port is formed on the bottom portion thereof, and a brush unit may be rotatably disposed inside the case. The case may provide an empty space so that the brush unit is rotatably provided therein. The brush unit may include a rotating shaft formed to extend to the left and right and a brush protruding from an outer circumference of the rotating shaft. The rotating shaft of the brush unit may be rotatably coupled to the left surface and the right surface of the case.

The brush unit is disposed such that the lower part of the brush protrudes through the suction port formed in the lower part of the case. Then, when the suction motor is driven, the brush unit may be rotated by the suction force to sweep up foreign substances including dust on the floor to be cleaned. The foreign substances swept up in this way may be sucked into the case by the suction force. The brush may be formed of a material that does not generate triboelectricity so that foreign substances may not easily adhere thereto.

The dust container 140 may include a hollow cylindrical case. A filter unit for filtering foreign substances and air from sucked air through the air suction passage of the main body 110 may be disposed inside of the cylindrical case. The filter unit may include a plurality of cyclones. Dust and foreign substances filtered by the filter unit may be accommodated by falling into the inside of the dust container 140 and only air is discharged to the outside of the dust container 140. Then, the air moves toward the suction motor by the suction force of the suction motor and then is discharged to the outside of the main body 110.

Figure 3:
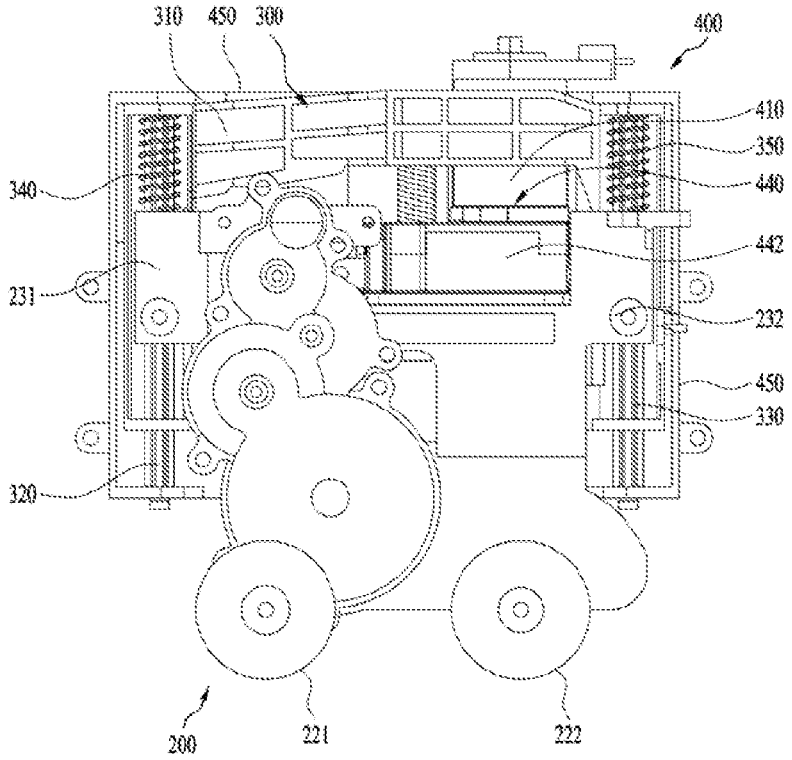
FIG. 3 is a view illustrating a wheel unit, a suspension unit, and a lifting unit.
Figure 4:
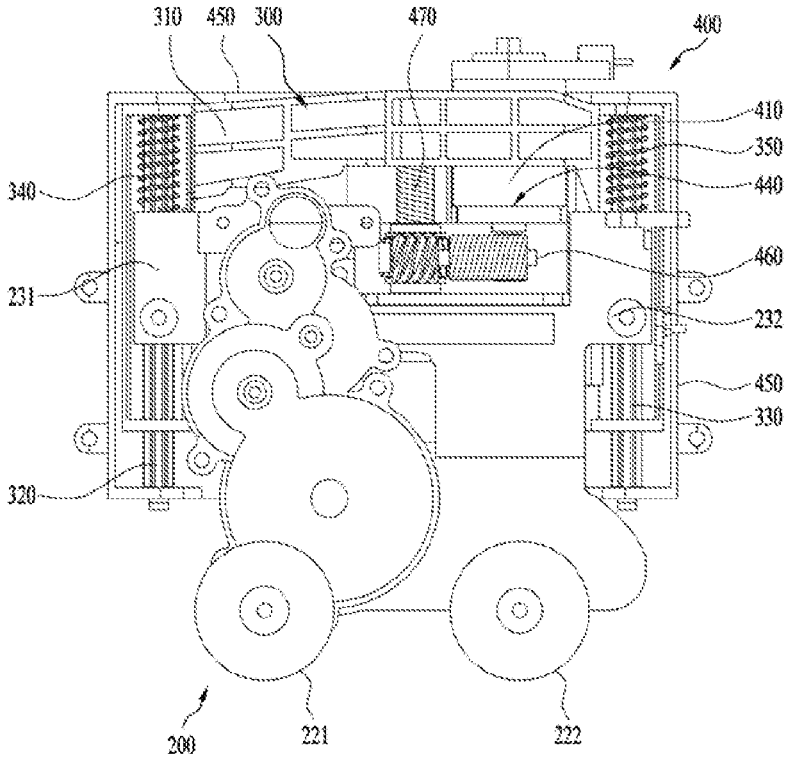
FIG. 4 is a view illustrating an interior of a transmission unit in FIG. 3.
Figure 5:
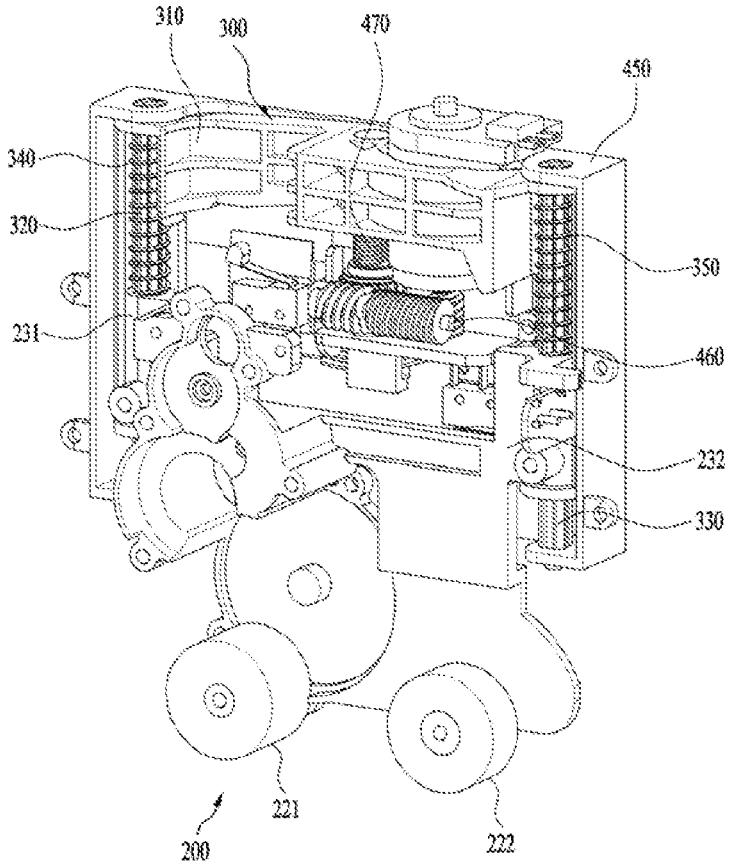
FIG. 5 is an oblique view of FIG. 4.

FIG. 3 is a view illustrating a wheel unit, a suspension unit, and a lifting unit, FIG. 4 is a view illustrating an interior of a transmission unit in FIG. 3, and FIG. 5 is an oblique view of FIG. 4.

Referring to FIGS. 3 to 5, the robot cleaner 100 according to the present disclosure includes a wheel unit 200, a suspension unit 300, and a lifting unit 400.

The wheel unit 200 is installed at each of both sides of the main body 110 to cause the main body 110 of the cleaner to travel. The wheel unit 200 may include a travel drive motor, wheels 221 and 222 rotated by the driving force of the travel drive motor to cause the main body 110 to travel, and a gear housing in which the travel drive motor and the wheels 221 and 222 are installed.

The wheel unit 200 includes a driving wheel 221 disposed at the front portion thereof and a driven wheel 222 disposed at a position spaced backward from the driving wheel 221. The driving wheel 221 and the driven wheel 222 may be connected via a travel belt. When the travel belt is provided, a plurality of protrusions is formed on the outer circumferential surface of the driving wheel 221 along a circumferential direction and a plurality of grooves into which the plurality of the protrusions formed on the outer circumferential surface of the driving wheel 221 is inserted is formed on the inner circumferential surface of the driving belt 223.

The suspension unit 300 installed in the wheel unit 200 absorbs impact transmitted by the wheel unit 200 when the main body 110 travels.

The suspension unit 300 includes a suspension frame 310, guide bars 320 and 330 installed in the suspension frame 310 to guide the wheel unit 200 to be movable upward and downward, and elastic members 340 and 350 configured such that the guide bars 320 330 may penetrate therethrough and configured to absorb impact when the wheel unit 200 moves upward or downward.

The wheel unit 200 is provided with bar installation portions 231 and 232 so that the guide bars 320 and 330 are installed in the bar installation portions 231 and 232. The bar installation portions 231 and 232 are installed to be movable upward and downward on the guide bars 320 and 330 so that the wheel unit 200 is disposed to be movable upward and downward in the suspension unit 300. The guide bars 320 and 330 penetrate upward and downward through the bar installation portions 231 and 232. Through-holes through which the guide bars 320 and 330 penetrate upward and downward are formed in the bar installation portions 231 and 232.

The suspension unit 300 is provided with the two guide bars 320 and 330, i.e., the front guide bar 320 and the rear guide bar 330 which are located at the front side and the rear side of the suspension unit 300, respectively. The bar installation portion 230 located at the front is installed to be movable upward and downward on the front guide bar 320 and the bar installation portion 232 located at the rear side of the suspension unit 300 is installed to be movable upward and downward on the rear guide bar 330.

The suspension frame 310 is formed in the shape of a square bracket as a whole, and the two guide bars 320 and 330 are disposed at both ends thereof, respectively. The guide bars 320 and 330 extend in a vertical direction so that the wheel unit 200 may move in a direction in which the guide bars 320 and 330 extend.

Two bar guides 320 and 330 are formed to be longer than a distance when the top end and bottom end of the suspension frame 310 are extended so that the guide bars 320 and 330 are disposed so as to penetrate through the top end and bottom end of the suspension frame 310.

The elastic members 340 and 350 are formed of coil springs so that the guide bars 320 and 330 penetrate upward and downward through the elastic members 340 and 350. The upper ends of the elastic members 340 and 350 are supported by the suspension frame 310 and lower ends of the elastic members 340 and 350 are supported by the bar installation portions 231 and 232. If impact is applied to the main body 110 or the wheel unit 200 while the main body 110 travels, the elastic members 340 and 350 may be compressed to absorb impact. The bar installation portions 231 and 232 of the wheel unit 200 are movably installed on the guide bars 320 and 330 to support the lower sides of the elastic members 340 and 350 so that the suspension unit 300 may absorb impact when the wheel unit 200 moves upward and downward. The elastic members 340 and 350 includes the front elastic member 340 through which the front guide bar 320 penetrates upward and downward, the bottom end of which is supported by the front bar installation portion, and the rear elastic member 350 through which the rear guide bar 330 penetrates upward and downward, the bottom end of which is supported by the rear bar installation portion.

The suspension unit 300 is coupled to the lifting unit 400 to be raised or lowered. The suspension unit 300 may change height with respect to the lifting unit 400.

The lifting unit 400 includes a housing 450 having a space for accommodating at least a portion of the suspension unit 300. Both ends of the guide bars 320 and 330 are coupled to the housing 450. The top ends and bottom ends of the guide bars 320 and 330 are coupled to the top end and the bottom end of the housing 450, respectively, so that the heights of the guide bars 320 and 330 may be extended to be similar to the height of the housing 450. The height between the top end and the bottom end of the housing 450 is the same as the height between the top end and the bottom end of each of the guide bars 320 and 330. The height between the top end and bottom end of the housing 450 is higher than the height between the top end and the bottom end of the suspension frame 310. The height between the top end and the bottom end of the suspension frame 310 is higher than the height between the top end and the bottom end of each of the bar installation portions 231 and 232. Therefore, the suspension frame 310 is guided to be raised or lowered by the guide bars 320 and 330 disposed in the housing 450. The bar installation portions 231 and 232 are guided to be raised or lowered by the guide bars 320 and 330 disposed in the suspension frame 310.

The lifting unit 400 may be coupled to the main body 110. In this case, the housing 450 may be coupled to the main body 110. The lifting unit 400 is provided to be lifted together with the main body 110. The lifting unit 400 may adjust the height of the main body 110 by lifting the main body 110 when moving upward and downward.

The lifting unit 400 includes a lifting drive motor 410 for providing driving force so that the lifting unit 400 is raised or lowered with respect to the suspension unit 300 and a transmission portion 440 for transmitting the rotational force of the lifting drive motor 410 to the suspension unit 300.

The lifting drive motor 410 is installed at the inner side of the housing 450. The lifting drive motor 410 is fixed so as not to change the position thereof with respect to the housing 450, whereas the lifting drive motor 410 may provide rotational force in a forward or reverse rotation direction.

In FIGS. 4 and 5, a cover 442 of the transmission portion 440 is omitted unlike FIG. 3 and the inside of the transmission portion 440 is illustrated.

Figure 6:
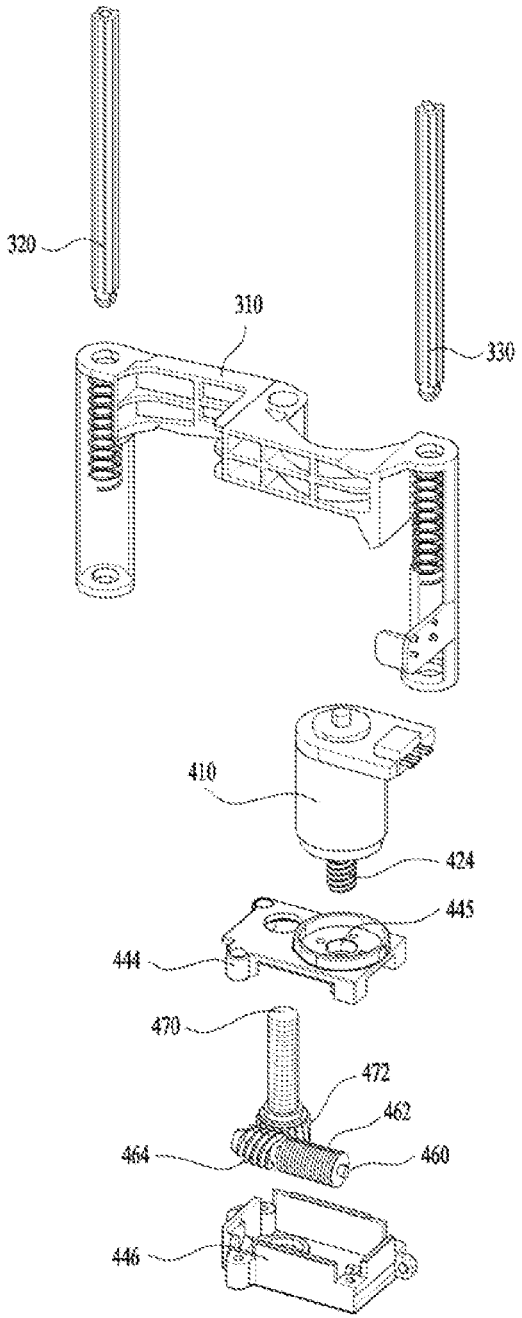
FIG. 6 is an exploded perspective view of main parts of the present disclosure.
Figure 7:
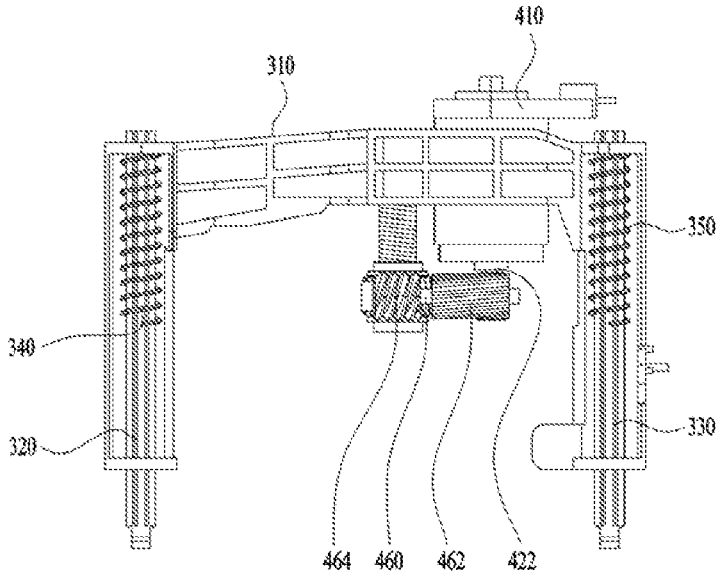
FIGS. 7 and 8 are views illustrating a state in which the main parts of FIG. 6 are coupled.
Figure 8:
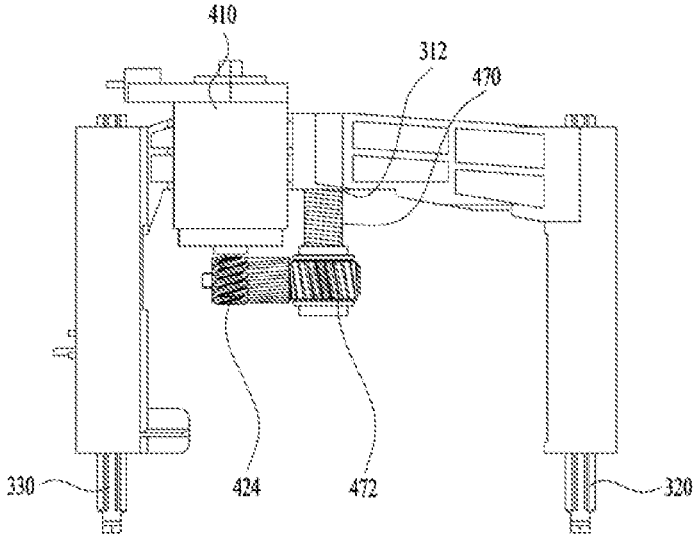

FIG. 6 is an exploded perspective view of main parts of the present disclosure, and FIGS. 7 and 8 are views illustrating a state in which the main parts of FIG. 6 are coupled. FIG. 8 is a view seen from the rear side of FIG. 7

Referring to FIGS. 6 to 8, the lifting drive motor 410 includes a rotating shaft 422 disposed in parallel with a direction in which the suspension unit 300 is lifted with respect to the lifting unit 400. The rotating shaft 422 is disposed in parallel with a direction in which the guide bars 320 and 330 extend.

The transmission portion 440 includes the cover installed in an inner space of the housing 450. The cover includes a first cover 444 disposed at the upper side thereof and a second cover 446 disposed at the lower side thereof. The second cover 446 is disposed below the first cover 444 and the two covers are combined to form a space in which components may be installed.

A through hole 445 through which the rotating shaft 422 of the lifting drive motor 410 penetrates is formed on the upper surface of the first cover 444. The rotating shaft 422 is provided with a first gear 424. When the rotating shaft 422 is rotated, the first gear 424 is also rotated at the same rotation speed and in the same rotation direction.

In addition, the transmission unit 440 includes a first rotary bar 460 rotated by being engaged with the rotating shaft 422 and a second rotary bar 470 rotated by being engaged with the first rotary bar 460. In this case, the first rotary bar 460 and the second rotary bar 470 are disposed perpendicular to each other. When the first rotary bar 460 is disposed horizontally, the second rotary bar 470 is disposed vertically. Therefore, the second rotary bar 470 is disposed in parallel with the rotating shaft 422.

The first rotary bar 460 may be rotatably coupled to the cover 442. In this case, the first rotary bar 460 is provided with a bearing so that the cover 442 may not move even if the first rotary bar 460 is rotated.

The first rotary bar 460 is provided with a second gear 462 engaged rotatably with the first gear 422. When the first gear 424 is rotated about a vertical rotating shaft, the second gear 462 is rotated about a horizontal rotating shaft. In this case, the first gear 424 may be a worm and the second gear 462 may be a worm wheel. The first gear and the second gear may vertically change a rotating shaft direction and may also change a rotation speed.

A third gear 464 is provided on the other side of the first rotary bar 460. The third gear 464 is rotated together when the first rotary bar 460 is rotated.

The second rotary bar 470 is provided with a fourth gear 472 rotated by being engaged with the third gear 464 and rotated. When the third gear 464 is rotated about a horizontal rotating shaft, the fourth gear 472 is rotated about a vertical rotating shaft. In this case, the third gear 464 may be a worm and the fourth gear 472 may be a worm wheel. The third gear and the fourth gear may vertically change a rotating shaft direction and also change a rotation speed.

In the transmission unit, a rotation speed may be adjusted to be reduced through the two worms and worm wheels. In addition, rotational force transmitted by the transmission portion initially has the axis of rotation in a vertical direction and rotational force transmitted through the transmission portion also finally has the axis of rotation in a vertical direction.

A thread is formed on the upper side of the second rotary bar 470, and a coupling hole 312 into which the second rotary bar 470 is inserted is formed in the suspension frame 310. The coupling hole 312 is formed with a thread that may be engaged with the thread formed on the second rotary bar 470 so that the suspension frame 310 moves upward or downward when the second rotary bar 470 is rotated.

The upper end of the second rotary bar 470 may be coupled to the coupling hole 312 of the suspension frame 310 and the lower end of the second rotary bar 470 may be coupled to the second cover 446. The lower end of the second rotary bar 470 is provided with a bearing so that the second rotary bar 470 may be rotatably coupled to the second cover 446.

Figure 9:
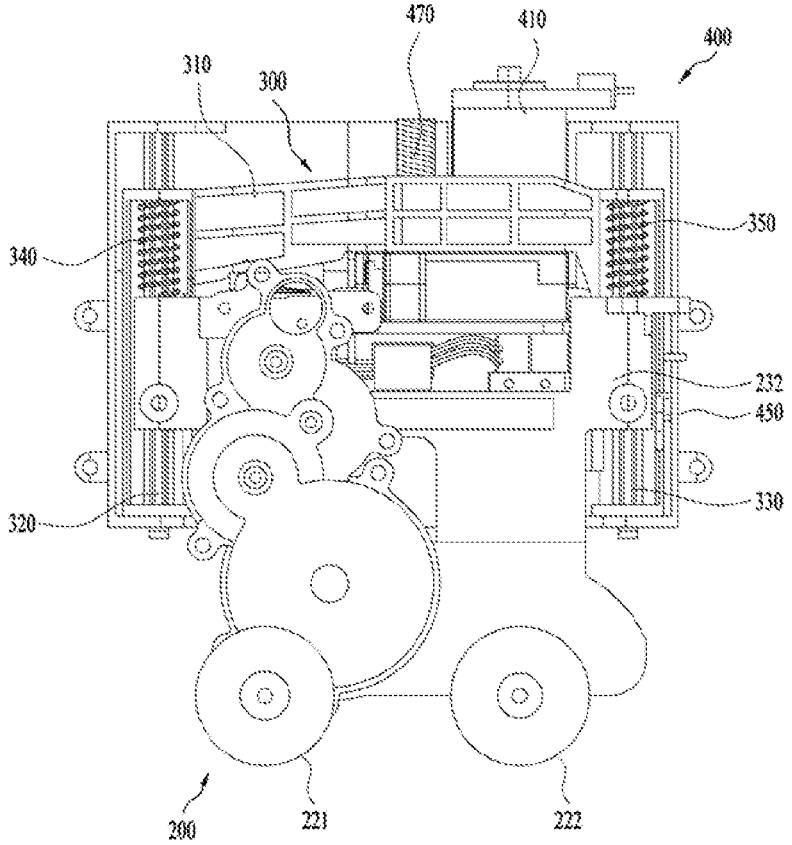
FIG. 9 is a view illustrating a state in which a suspension unit is lowered with respect to a lifting unit.

FIG. 9 is a view illustrating a state in which a suspension unit is lowered with respect to a lifting unit.

As compared with FIG. 3, the suspension unit 300 and the wheel unit 200 are in a lowered state in FIG. 9 relative to the position of the lifting unit 400. Therefore, the main body 110 coupled to the lifting unit 400 so as not to change height is higher than the wheel unit 200. This is because the wheel unit 200 is in contact with a floor while traveling.

A process in which the suspension unit 300 is lowered with respect to the lifting unit 400 will be omitted.

If rotational force is generated by the lifting drive motor 410, the first gear 424 is rotated while the rotating shaft 422 is rotated. The second gear 462 engaged with the first gear 424 is rotated and the third gear 464 coupled to the first rotary bar 460 is also rotated together with the second gear 462.

The rotation of the third gear 464 is transmitted to the fourth gear 472 to rotate the second rotary bar 470. Rotation of the second rotary bar 470 may change the height of the suspension frame 310 with respect to the second rotary bar 470. The suspension unit 300 may be raised or lowered using a vertical direction in which the guide bards 320 and 333 are extended as a movement trajectory.

That is, when the rotating shaft 422 of the lifting drive motor 410 is rotated forward or backward (clockwise or counterclockwise about a central axis of the rotating shaft), the suspension unit 300 may be raised or lowered with respect to the lifting unit 400 so that the height of the suspension unit 300 may be changed.

In this embodiment, the trajectory of the suspension unit 300 moving with respect to the lifting unit 400 may be guided by the guide bars 320 and 330. In addition, the trajectory of the wheel unit 200 moving with respect to the suspension unit 300 may be guided by the guide bars 320 and 330. That is, the movement trajectories of the suspension unit 300, the lifting unit 400, and the wheel unit 200 may be limited altogether by the guide bars 320 and 330, and functions may be implemented by sharing the guide bars 320 and 330. Therefore, there is an advantage that a configuration is simplified.

Figure 10:
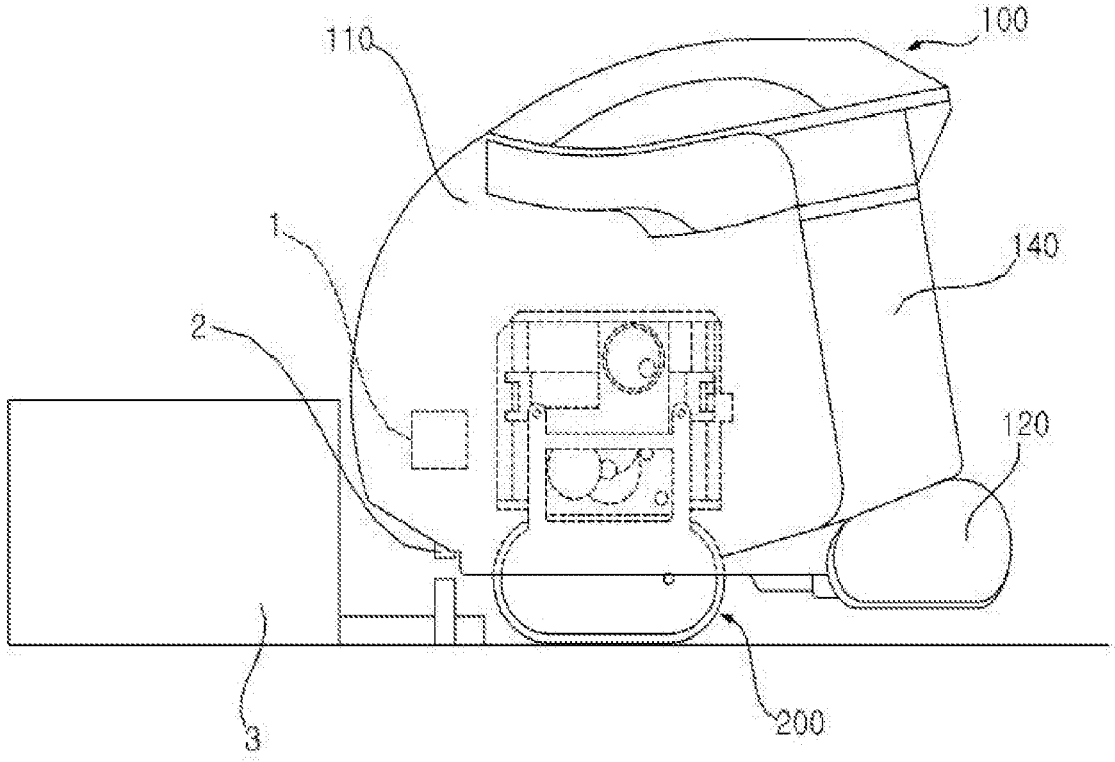
FIG. 10 is a view illustrating docking of a robot cleaner on an external docking device according to an embodiment of the present disclosure.
Figure 11:
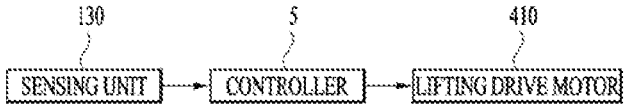
FIG. 11 is a control block diagram of a robot cleaner according to an embodiment of the present disclosure.

FIG. 10 is a view illustrating docking of a robot cleaner with an external docking device according to an embodiment of the present disclosure and FIG. 11 is a control block diagram of a robot cleaner according to an embodiment of the present disclosure.

Referring to FIGS. 10 and 11, the robot cleaner 100 according to an embodiment of the present disclosure is provided with a battery 1 inside the main body 110. The battery 1 stores electricity for driving various electrical components provided in the main body 110. A charging port 2 for charging the battery 1 is disposed on the lower surface of the main body 110. The charging port 2 may be connected to an external docking device for charging. The charging port 2 may be connected to a supply terminal 4 disposed in an external docking device 3 to charge the battery 1. The docking device 3 may be a charging station. The cleaner 100 may automatically travel to the location of the docking device 3 when the amount of charge of the battery 1 is less than or equal to a predetermined value so that the main body 110 may dock with the docking device 3. When the cleaner 100 finishes cleaning, the cleaner 100 may automatically travel to the position of the docking device 3 so that the main body 110 may dock with the docking device 3.

The controller 5 may control the lifting unit 400 using a sensing value input by the sensing unit 130 so as to lift the lifting unit 400. For example, the controller 5 may receive location information of the docking device 3 from the sensing unit 130 to identify the location of the docking device 3. The charging port 2 is disposed on the lower surface of the main body 100. When the main body 100 attempts to dock with the docking device 3, the controller 5 controls the lifting drive motor 410 to be rotated in one direction to raise the lifting unit 400 so that the main body 110 moves upward. After raising the lifting unit 400, the controller 5 controls the lifting drive motor 410 to be rotated in another direction to lower the raised lifting unit 400 so that the main body 100 moves downward. Then, the controller 5 may control the charging port 2 to be connected to the supply terminal 4 of the docking device 3.

In addition, the cleaning nozzle 120 is formed with a suction port on the lower surface thereof to suck foreign substances of a floor. Thus, when the cleaner 100 travels along a floor surface to be cleaned, if the material of the floor surface is carpet, strands of the carpet are sucked through the suction port of the cleaning nozzle 120 and then traveling performance of the cleaner may be degraded. Therefore, the lifting unit 400 may move upward or downward by controlling the lifting drive motor 410 according to the material of the floor surface to be cleaned so that the height of the cleaning nozzle 120 may be controlled. The sensing unit 130 may obtain floor information related to the material of the floor surface and the controller 5 may receive the floor information from the sensing unit 130. Herein, the sensing unit 130 may be at least one of a distance sensor, a reflectance measurement sensor, or an image sensor, that may acquire the floor information related to the material of the floor surface. Upon determining that the material of the floor surface is a carpet based on the floor information provided by the sensing unit 130, the controller 5 may control the lifting drive motor 410 to be rotated in one direction to move the cleaning nozzle 120 upward, thereby raising the lifting unit 400. Upon determining that the cleaner 100 has exited from the carpet based on the floor information, the controller 5 may control the lifting drive motor 410 to be rotated in another direction to move the cleaning nozzle 120 downward, thereby lowering the lifting unit 400.

As described above, in the cleaner according to an embodiment of the present disclosure, the lifting unit for raising the main body 110 is installed in the suspension unit 300. Therefore, even if the height of the main body 110 of the cleaner is adjusted by the lifting unit 400, the suspension unit 300 may maintain a function of absorbing impact of the wheel unit 200.

According to the robot cleaner of the present disclosure, the suspension unit may maintain a function of absorbing impact even when the height of the main body is adjusted by the lifting unit for lifting the main body since the lifting unit is installed in the suspension unit.

In addition, since the height of the cleaning nozzle is lifted when the cleaning nozzle passes through a carpet, which is the material of a floor, to suck foreign substances, strands of the carpet are not sucked into the suction port formed on the lower surface of the cleaning nozzle and thus traveling performance of the main body is not degraded.

Furthermore, since the main body is lifted upon attempting to dock with an external docking device to charge a battery, the charging port disposed on the lower surface of the main body may be electrically connected to the docking device in a stable state.

The present disclosure is not limited to the above-described embodiments and various modifications and variations can be made herein by those of ordinary skill in the art as can be appreciated by the appended claims. Further, such modifications and variations come within the scope of the present disclosure.

What is claimed is:

1. A robot cleaner comprising:

a main body;

a wheel unit including a wheel configured for movably supporting the main body;

the wheel unit being installed in a suspension unit and configured to be movable upward or downward relative to the suspension unit, the suspension unit being configured to absorb impact when the wheel unit moves upward or downward; and the suspension unit being installed in a lifting unit and configured to be raised or lowered relative to the lifting unit, the lifting unit being coupled to the main body, wherein the lifting unit includes a lifting drive motor including a rotatable shaft disposed in parallel with a direction in which the suspension unit is configured to be raised or lowered relative to the lifting unit, and a transmission unit configured to transmit a rotation force of the lifting drive motor to the suspension unit.

2. The robot cleaner of claim 1, wherein a clockwise or a counterclockwise rotation of the rotatable shaft of the lifting drive motor about a central axis of the rotatable shaft causes the suspension unit to be raised or lowered relative to the lifting unit.

3. The robot cleaner of claim 1, wherein the transmission unit includes a first rotary bar rotatably engaged with the rotatable shaft, and a second rotary bar rotatably engaged with the first rotary bar, and wherein the first rotary bar and the second rotary bar are disposed perpendicular to each other.

4. The robot cleaner of claim 3, wherein the second rotary bar is disposed in parallel with the rotatable shaft.

5. The robot cleaner of claim 3, wherein the second rotary bar is rotatably coupled to the suspension unit.

6. The robot cleaner of claim 5, wherein the second rotary bar is formed with a thread and the suspension unit is configured to be raised or lowered when the second rotary bar is rotated in a first direction or a second direction about a central axis of the second rotary bar.

7. The robot cleaner of claim 1, wherein the suspension unit includes a suspension frame, a guide bar installed in the suspension frame and configured to guide the wheel unit to be movable upward and downward, and an elastic member through which the guide bar penetrates, the elastic member being configured to absorb an impact when the wheel unit moves upward and downward.

8. The robot cleaner of claim 7, wherein the lifting unit includes a housing, and opposite ends of the guide bar are coupled to the housing.

9. The robot cleaner of claim 7, wherein the guide bar passes through and protrudes from an upper end and a lower end of the suspension frame.

10. The robot cleaner of claim 7, wherein the wheel unit includes a bar installation portion, and the guide bar passes through the bar installation portion.

11. The robot cleaner of claim 1, further comprising a sensing unit including at least one of an obstacle sensor, a floor sensor, or a position sensor, and a controller configured to receive a signal from the sensing unit and drive the lifting drive motor based on the signal from the sensing unit.

12. The robot cleaner of claim 11, further comprising a charging portion disposed on a lower surface of the main body, wherein the controller is configured to drive the lifting drive motor to cause the main body to move upward when the main body attempts to dock with an external docking device.

13. The robot cleaner of claim 11, further comprising a cleaning nozzle coupled to the main body and provided with a suction port configured to suck foreign substances from a floor, wherein the controller is configured to drive the lifting drive motor to cause the cleaning nozzle to move upward upon determining that a material of the floor is a carpet sed on the signal from the sensing unit.

* * * * *